US005631455A

United States Patent [19]

Stenta

[11] Patent Number: 5,631,455

[45] Date of Patent: May 20, 1997

[54] PENDULUM ACTUATED SWITCH

[76] Inventor: Richard A. Stenta, 5405 Round Hill La., Raleigh, N.C. 27604

[21] Appl. No.: 514,154

[22] Filed: Aug. 11, 1995

[51] Int. Cl.[6] ..... H01H 35/02; H01H 35/14

[52] U.S. Cl. ..... 200/61.48; 200/61.52; 200/61.83; 200/462; 200/467

[58] Field of Search ..... 200/61.45 R, 61.45 M, 200/61.46, 61.48, 61.49, 61.5, 61.51, 61.52, 402–472, 61.83

[56] References Cited

U.S. PATENT DOCUMENTS

| | | | |
|---|---|---|---|
| 1,256,134 | 2/1918 | Joeck | 200/61.48 |
| 2,737,549 | 3/1956 | Thomson | 200/61.5 |
| 2,897,306 | 7/1959 | Weaver | 200/61.45 R |
| 3,392,246 | 7/1968 | Hall | 200/61.5 |
| 4,814,558 | 3/1989 | Tanabe | 200/440 |
| 4,929,808 | 5/1990 | Roeser et al. | 200/467 |
| 5,192,838 | 3/1993 | Breed et al. | 200/61.48 X |

*Primary Examiner*—J. R. Scott

[57] ABSTRACT

A tilt responsive switch supported on a hinged structure such as a trunk lid, door or the like includes an oscillating mass or pendulum rotatingly held by a bearing structure located within the switch housing and a pair or electrical terminals electrically connected by a movable contact mechanism. The pendulum effectively controls the motion of the movable contact mechanism. When the electrical terminals are connected by the movable contact mechanism, the pendulum abuts against a first internal switch housing limit bumper. When the pendulum abuts against a second switch housing limit bumper, the movable contact mechanism is disconnected from the electrical terminals.

5 Claims, 2 Drawing Sheets

PENDULUM ACTUATED SWITCH

BRIEF SUMMARY OF THE INVENTION

This invention relates to electrical switches and particularly to switches controlled by movement of a hinged lid or the like.

In a number of applications involving lids swinging on horizontal hinges, such as the trunk and hood lids of automobiles, it is desirable to activate an electrical circuit such as a lamp when the lid is in an open position and deactivate the circuit when the lid is in a closed position. The switch of the present invention is affixed to such a lid and employs a pendulum which swings in response to movement of the lid to control the closing or opening of the switch.

DETAILED DESCRIPTION

Figure 1:
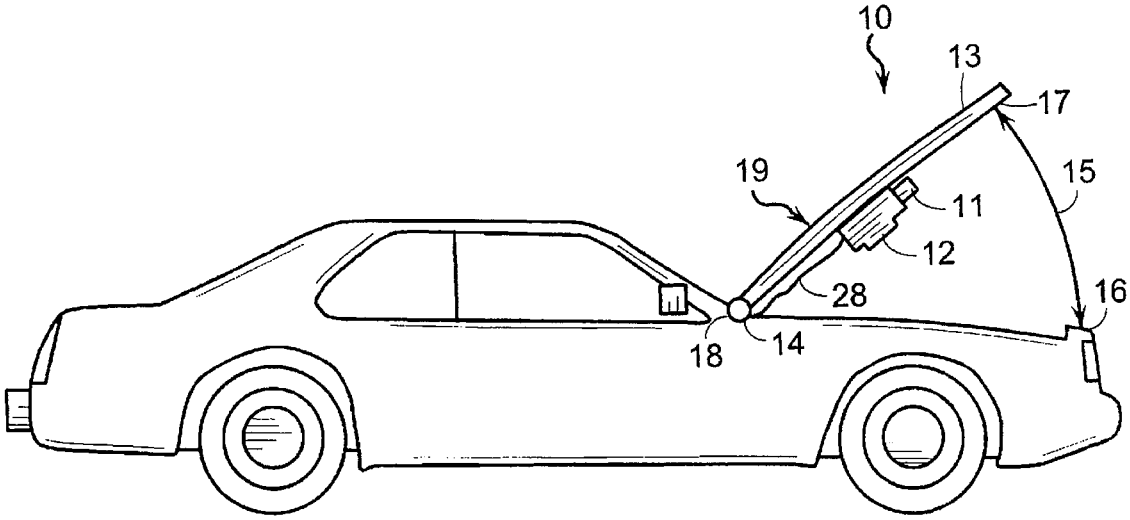
FIG. 1 shows a switch affixed to an automobile hood lid and controlling a lamp according to the invention.

As shown in FIG. 1, apparatus 10 according to the invention includes switch 11 affixed to lamp 12 and to auto hood lid 13, which is supported by hinge 14 with horizontal axis 18. The structure 19 including lid 13, lamp 12 and switch 11 rotates on hinge 14 through a range 15 from a limit position 1G to a limit position 17.

Figure 2:
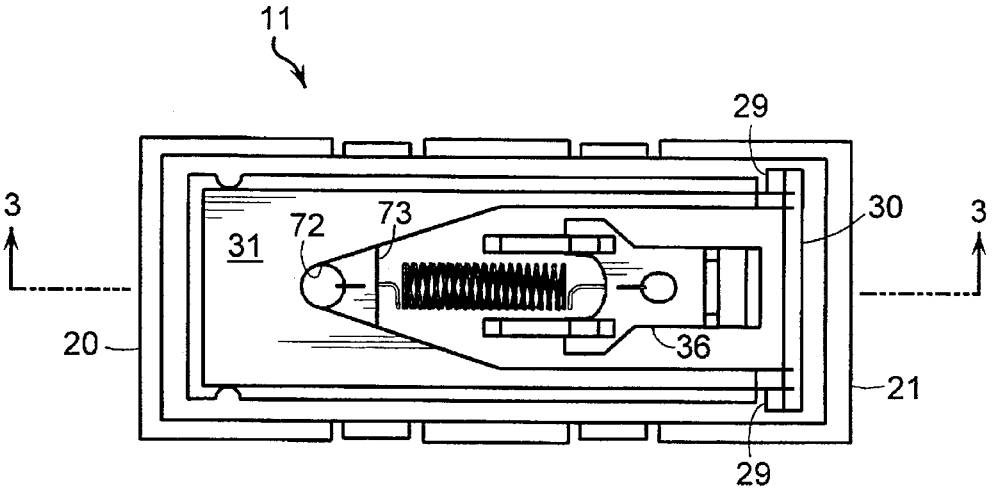
FIG. 2 shows a view from the top of the switch of FIG. 1, the cover of the switch being removed to reveal interior structure.
Figure 3:
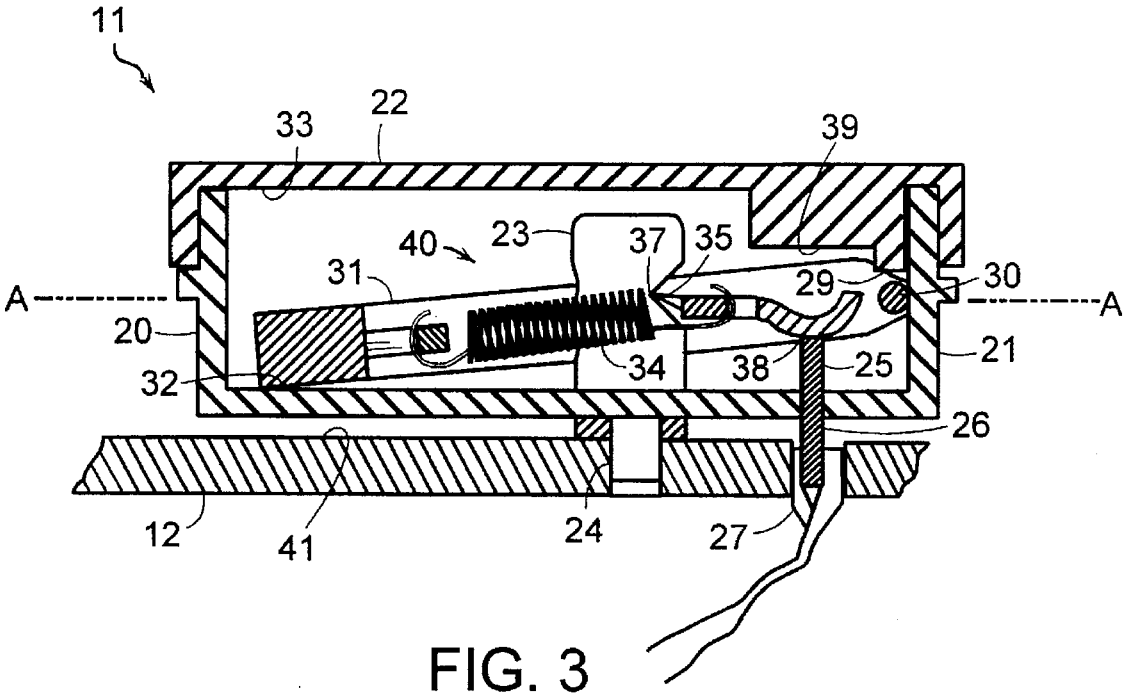
FIG. 3 shows a sectional view of the switch of FIG. 2 along the section 3—3, the cover of the switch being in place.
Figure 4:
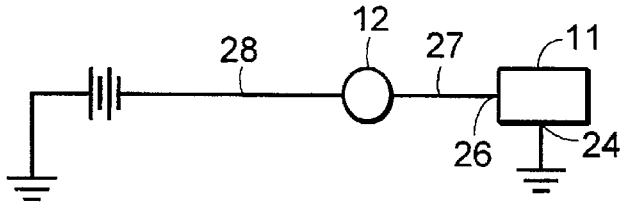
FIG. 4 schematically the electrical circuitry connecting the switch of FIG. 1.

As shown more particularly in FIGS. 2, 3, and 4, switch 11 includes housing 20 which is formed of box 21 and cover 22. Electrical terminal 23 is affixed in housing 20 and has a portion 24 external to housing 20 which is connected to lamp 12 at interface 41 connected in turn to lid 13 and serving as an electrical ground. Electrical terminal 25 is also affixed to housing 20 and has portion 2G connected to electrical conductor 27 which is connected in turn through lamp 12 to power source 28.

Bearing structure 29 holds axle 30 of pendulum 31 permitting pendulum 31 to rotate between stop bumper 32 in one direction and stop bumper 33 in the opposite direction.

Mechanism 40 including spring 34 and flipper 36 electrically connects terminal 23 to terminal 25 when pendulum 31 is rotated against stop bumper 32 and disconnects terminal 23 from terminal 25 when pendulum 31 is rotated against stop bumper 33. More specifically, spring 34 connected to aperture 72 in portion 73 of pendulum 31 pulls pivot edge 35 of electrically conductive flipper 36 into notch 37 of terminal 23 and, when pendulum 31 abuts against stop bumper 32, urges contacting area 38 of flipper 36 against terminal 25. When pendulum abuts against bumper 33, spring 34 urges flipper 36 away from terminal 25 and against flipper limiting structure 39 which limits movement of flipper 36 away from terminal 39.

Switch housing 20 is affixed through its terminals to the housing of lamp 12 through interface 41 and thereby to lid 13. Interface 41 is designed to correctly orient housing 20 and the switch parts therein. The housing 20 is advantageously oriented with its axis A—A (as shown in FIG. 3) parallel to hinge axis 18 and with stop bumpers 32 and 33 aligned so that when lid 13 is midway in range 1S the line of bumpers is horizontal, and when the lid is at limit position 17 bumper 33 is above bumper 32, and when the lid is at limit position 16 bumper 32 is above bumper 33. So affixed, when the lid 13 is at limit position 17 pendulum 31 will fall against bumper 32, connecting the lamp to the power source, and when the lid is at limit position 16 fall against bumper 33 disconnecting the lamp The over center mechanism 40 somewhat stabilizes an existing state of the switch to provide backlash so that the switching point from off to on will be somewhat above the lid position giving equal elevation to the bumpers and the switching point from on to off will be somewhat below the lid position giving equal elevation to the bumpers. This prevents the switch from jittering on and off at the switch point.

The switch may also be affixed to the hinged structure with an orientation in which the hinge axis is perpendicular to the plane of the paper in the drawing shown in FIG. 3. The switching point will occur as before when bumpers 32 and 33 are of equal height, but this condition can occur either with the pendulum above its axle or below its axle. When the switch point with the pendulum above its axle is used, additional hysteresis in the switching is produced which may be advantageous in certain applications. The orientation of the switching apparatus according to the invention does not require that the hinge axis be strictly horizontal or strictly oriented to the axis of the switch as described above. A suitable switching point can be obtained by appropriate design of the interface or other means of orienting the switch elements whenever the condition that the angle between the hinge axis and the line between the bumpers is greater than the angle between the hinge axis and the horizontal is met.

I claim:

1. Apparatus including a pendulum with an axle, a hinged structure supported by a hinge, said hinge having a hinge axis oriented to have a horizontal projection, said hinged structure rotating on said hinge over a range extending from a first limit position to a second limit position, said hinged structure including bearing structure holding said axle while permitting rotation of said pendulum, a first stop bumper limiting rotation of said pendulum on said axle in a first direction and a second stop bumper limiting rotation of said pendulum on said axle in a second direction opposite to said first direction, a first terminal affixed to said hinged structure with a portion thereof connectable to electrical circuitry, a second terminal affixed to said hinged structure with a portion thereof connectable to electrical circuitry, mechanism connected to said pendulum and said hinged structure which electrically connects said first terminal to said second terminal when said pendulum is rotated against said first stop bumper and disconnects said first terminal from said second terminal when said pendulum is rotated against said second stop bumper, said hinge axis, said first stop bumper, and said second stop bumper being positioned and oriented so that said first bumper is below said second bumper when said hinged structure is at said first limit position and said first bumper is above said second bumper when said hinged structure is at said second limit position.

2. A switch for affixing to a hinged structure, said hinged structure being supported on a hinge with a horizontal axis, said switch including a housing, a first electrical terminal affixed to said housing and providing a region external to said housing connectable to electrical circuitry, a second electrical terminal affixed to said housing and providing a region external to said housing connectable to electrical circuitry, and a pendulum with an axle, said housing providing bearing structure for holding said pendulum axle while permitting said pendulum to rotate on said axle, a first stop bumper limiting rotation of said pendulum on said axle in a first direction and a second stop bumper limiting rotation of said pendulum on said axle in a second direction opposite to said first direction, said switch further including mechanism connected to said pendulum which electrically connects said first terminal to said second terminal when said pendulum is rotated against said first stop bumper and disconnects said first terminal from said second terminal when said pendulum is rotated against said second stop bumper.

3. A switch as claimed in claim 2, wherein said first electrical terminal has a notch therein, said mechanism includes an electrically conductive flipper, said flipper having a pivot edge and a contacting area, and said flipper is connected to said pendulum by a spring which when said pendulum is against said first stop bumper urges the pivot edge of said flipper into said notch and the contacting area of said flipper against said second terminal, and when said pendulum is against said second stop bumper urges the contacting area of said flipper away from said second terminal.

4. A switch as claimed in claim 3, wherein said housing includes a flipper limiting structure limiting movement of said flipper away from said second terminal.

5. A switch as claimed in claim 2, wherein said mechanism connects said first and second terminals when said pendulum is at a position closer to said first bumper than the position at which said mechanism disconnects said first and second terminals.

* * * * *